US008074731B2

(12) United States Patent
Iwata et al.

(10) Patent No.: US 8,074,731 B2
(45) Date of Patent: Dec. 13, 2011

(54) IMPACT TOOL

(75) Inventors: Kazutaka Iwata, Hitachinaka (JP); Shinji Watanabe, Hitachinaka (JP); Nobuhiro Takano, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 174 days.

(21) Appl. No.: 12/530,621

(22) PCT Filed: Sep. 19, 2008

(86) PCT No.: PCT/JP2008/067578
§ 371 (c)(1),
(2), (4) Date: Sep. 9, 2009

(87) PCT Pub. No.: WO2009/038230
PCT Pub. Date: Mar. 26, 2009

(65) Prior Publication Data

US 2010/0096155 A1 Apr. 22, 2010

(30) Foreign Application Priority Data

Sep. 21, 2007 (JP) ..... 2007-246249
Sep. 21, 2007 (JP) ..... 2007-246258

(51) Int. Cl.
*B25B 21/02* (2006.01)

(52) U.S. Cl. ..... 173/2; 173/176; 173/178; 173/109; 318/257; 318/430

(58) Field of Classification Search ..... 173/104, 173/109, 2, 176, 178, 201, 205; 318/257, 318/284, 430, 461
See application file for complete search history.

(56) References Cited

U.S. PATENT DOCUMENTS

| | | | | | |
|---|---|---|---|---|---|
| 3,586,949 | A * | 6/1971 | Spear et al. | 318/257 |
| 4,412,158 | A | 10/1983 | Jefferson et al. | |
| 4,513,381 | A * | 4/1985 | Houser et al. | 700/168 |
| 5,245,747 | A * | 9/1993 | Hansson | 29/703 |
| 5,463,293 | A * | 10/1995 | Matsui | 318/285 |
| 5,526,460 | A * | 6/1996 | DeFrancesco et al. | 388/831 |
| 5,594,306 | A * | 1/1997 | Caporusso et al. | 318/245 |
| 5,731,673 | A | 3/1998 | Gilmore | |
| 6,172,472 | B1 * | 1/2001 | Klingbeil | 318/244 |
| 6,479,958 | B1 | 11/2002 | Thompson et al. | |
| 7,112,934 | B2 * | 9/2006 | Gilmore | 318/432 |
| 7,121,358 | B2 * | 10/2006 | Gass et al. | 173/2 |

FOREIGN PATENT DOCUMENTS

| | | |
|---|---|---|
| JP | 2004-322262 A | 11/2004 |
| JP | 2005-137134 A | 5/2005 |
| WO | WO 2006/121085 A1 | 11/2006 |

* cited by examiner

*Primary Examiner* — Scott A. Smith
(74) *Attorney, Agent, or Firm* — Kilpatrick Townsend & Stockton LLP

(57) ABSTRACT

An impact tool (100) includes a spindle (11), a motor (1), a rotational impact system (10), a current detecting unit (32), and a current control unit (31). The spindle extends in an axial direction thereof. The motor provides the spindle with a rotational power in accordance with a motor current flowing therethrough. The rotational power rotates the spindle about the axis at an rpm value. The rotational impact system provides the spindle with an impact force in the axial direction, thereby transmitting both the rotational power and the impact force to an end bit. The current detecting unit detects a current value of the motor current. The current control unit reduces the current value if the current value detected by the current detecting unit exceeds a predetermined value.

4 Claims, 14 Drawing Sheets

IMPACT TOOL

TECHNICAL FIELD

The present invention relates to an impact tool such as an impact driver or an impact wrench.

BACKGROUND ART

An impact tool disclosed in Japanese Patent Application Publication No. 2002-46078 drives a rotational impact system, with a battery pack as a power source and with a motor as a driving source, so as to give a rotary motion to and an impact on an anvil. The impact tool then intermittently transmits the rotational impact force to an end bit to tighten a screw, and the like. A direct-current motor having a brush and a commutator is known as a motor which has been employed as the driving source. On the other hand, several attempts to employ a brushless direct-current motor instead of the direct-current motor, is also made. Since brushless direct-current motor is more excellent in torque characteristics than the direct-current motor with brush, the impact tool that employs the brushless direct-current motor can tighten a screw, a bolt, or the like, into a workpiece more powerfully.

DISCLOSURE OF INVENTION

Technical Problem

However, in order to tighten a member of hard material such as a bolt or a nut, a large impact reaction force unavoidably occurs between an anvil and a hammer for hitting the anvil. In addition to the impact reaction force, the driving force of the brushless direct-current motor also moves the hammer backward to a large extent. If the hammer moves backward to an excessive degree, a larger impact force is applied onto the system facing the hammer due to the collision therebetween, thereby breaking the system.

Technical Solution

In view of the foregoing, it is an object of the present invention to provide an impact tool which facilitates a tightening operation with a large torque, as well as which prevents a system facing a hammer from breaking when a rotational impact force occurs.

In order to attain the above and other objects, the present invention provides an impact tool including a spindle, a motor, a rotational impact system, a current detecting unit, and a current control unit. The spindle extends in an axial direction thereof. The motor provides the spindle with a rotational power in accordance with a motor current flowing therethrough. The rotational power rotates the spindle about the axis at an rpm value. The rotational impact system provides the spindle with an impact force in the axial direction, thereby transmitting both the rotational power and the impact force to an end bit. The current detecting unit detects a current value of the motor current. The current control unit reduces the current value if the current value detected by the current detecting unit exceeds a predetermined value.

In this configuration, the impact by the spindle can be prevented from being excessive.

Preferably, the current control unit reduces the current value during a first time period including a timing at which the rotational impact system provides the spindle with the impact force if the current value detected by the current detecting unit exceeds the predetermined value.

In this configuration, the impact by the spindle can be effectively prevented from being excessive.

Preferably, the impact tool further includes an rpm detecting unit configured to detect the rpm value; and a minimum rpm determining unit configured to determine a minimum rpm from a plurality of rpm values detected, during a second time period, by the rpm detecting unit. The current control unit starts to reduce the current value after a third time period has elapsed since the minimum rpm determining unit had determined the minimum rpm value.

In this configuration, the time at which the impact occurs can be detected reliably.

Preferably, the impact tool further includes a maximum rpm determining unit configured to determine a maximum rpm from the plurality of rpm values detected, during the second time period, by the rpm detecting unit; and a period changing unit configured to change the first time period based on a period after the maximum rpm is detected before the minimum rpm is detected.

In this configuration, the intervals can be corrected even when the impact by the spindle occurs at uneven intervals.

Preferably, the impact tool further includes an impact interval detecting unit configured to detect an impact interval at which the rotational impact system hits the end bit based on the period after the maximum rpm is detected before the minimum rpm is detected. The period changing unit changes the first time period so that the first time period becomes longer than a reference time period, if the impact interval detected by the impact interval detecting unit is longer than a reference interval. The period changing unit changes the first time period so that the first time period becomes shorter than the reference time period, if the impact interval detected by the impact interval detecting unit is shorter than the reference interval.

In this configuration, the intervals can be corrected reliably even when the impact by the spindle occurs at uneven intervals.

Preferably, the current control unit reduces the current value if the current detecting unit detects the current value exceeding the predetermined value a predetermined number of times during a fourth time period.

In this configuration, the excessive impact by the spindle can be prevented reliably from occurring.

Preferably, the current control unit maintains the current value if the current detecting unit fails to detect the current value exceeding the predetermined value during a fifth time period.

In this configuration, the current value is not reduced when it is not desirable to reduce the current value. Therefore, a screw or the like can be securely tightened in a wooden board or the like Preferably, the motor is a brushless direct-current motor.

In this configuration, the impact tool can tighten a screw, a bolt, or the like, into a workpiece more powerfully.

Advantageous Effects

With the invention described above, the impact by the spindle is prevented from being excessive, thereby preventing the spindle from moving backward to an excessive degree to crash into the opposite wall.

EXPLANATION OF REFERENCE

Figure 1:
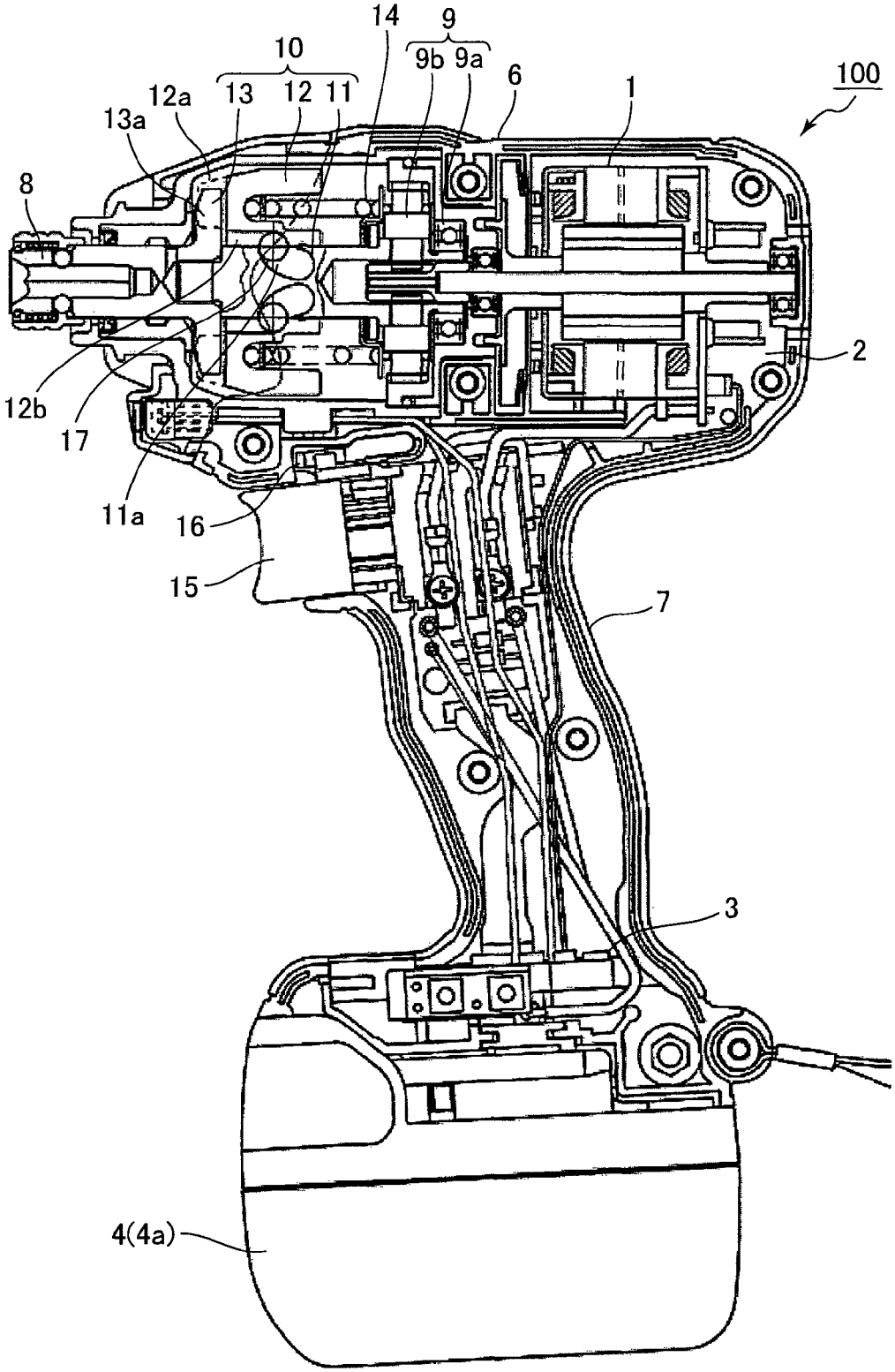
FIG. 1 shows a whole configuration of an electric tool according to embodiments of the present invention.

100 impact driver
1 brushless direct-current motor
2 inverter
3 control circuit section
31 operation unit
32 current detection circuit
33 applied voltage setting circuit
36 rotational speed detection circuit
37 control signal output circuit
10 rotational impact system
11 spindle

BEST MODE FOR CARRYING OUT THE INVENTION

Hereinafter, preferred modes of the present invention will be described with reference to the accompanying drawings.

Mode for the Invention 1

Figure 2:
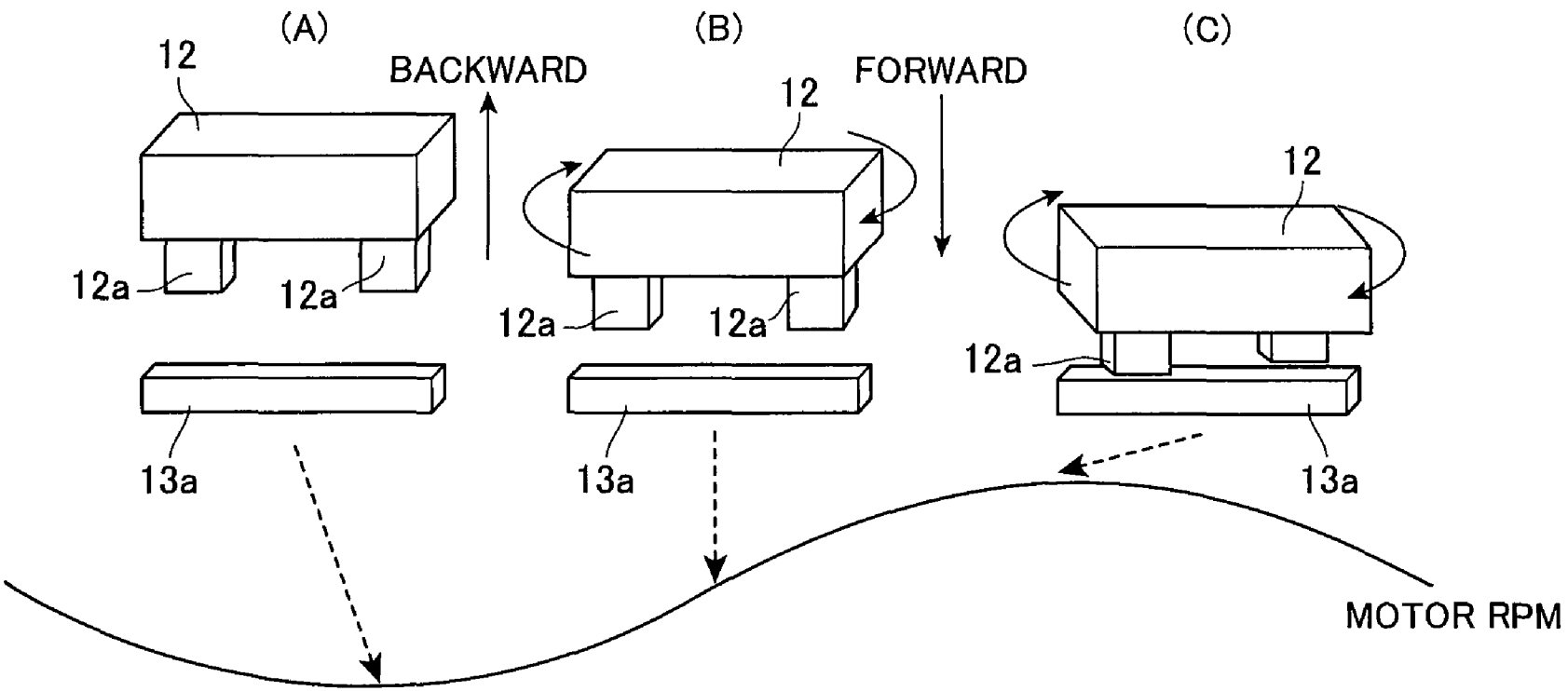
FIG. 2 schematically illustrates the relation between an operation of a rotational impact system included in the electric tool shown in FIG. 1 and a motor rpm.
Figure 3:
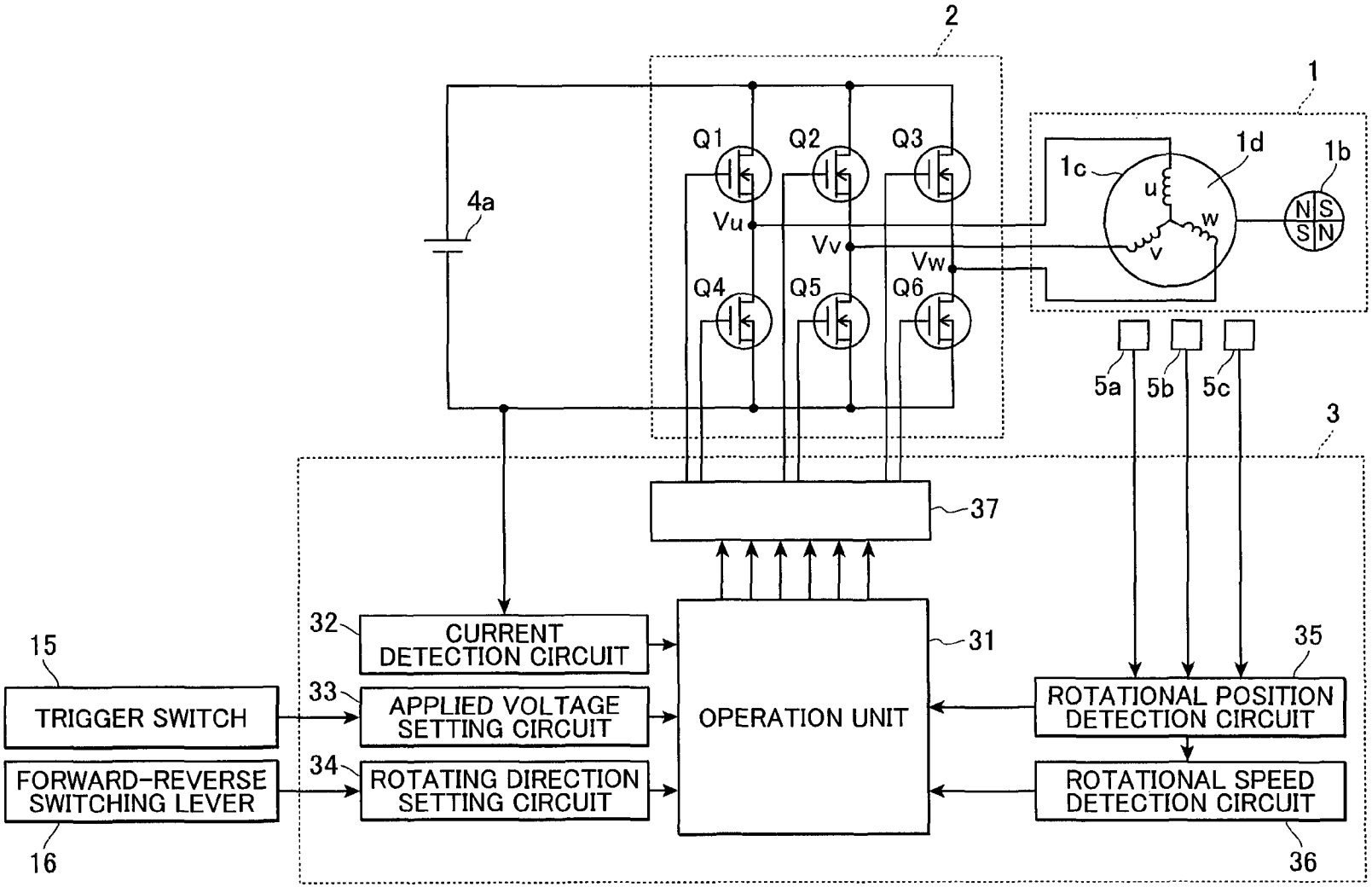
FIG. 3 is a functional block diagram showing a motor driving control system of the electric tool shown in FIG. 1.

FIG. 1 shows a whole configuration of an electric tool, in which the present invention is applied to a cordless impact driver. FIG. 2 illustrate an operation of a rotational impact system. FIG. 3 is a block diagram showing a configuration of a motor driving unit of the electric tool which includes a brushless direct-current motor.

Referring first to FIG. 1, a configuration of an impact driver 100 according to modes of the present invention is described. The impact driver 100 includes a tool body which has a main body housing 6 extending from one end thereof (right in the figure) to the other end (left in the figure), in the same direction (horizontal direction) as the rotating shaft of a brushless direct-current motor 1 to be described later (hereinafter, referred to as a "motor 1"); and a handle housing 7 projecting downward from the main body housing 6. An end bit holder 8 is provided at the other end of the main body housing 6. Although not shown, a driver bit (end bit) is detachably mounted to the end bit holder 8 so that a screw is tightened into a workpiece in the use of the rotational impact force applied from the tool body. Instead of the driver bit, a bolt-tightening bit can be mounted as an end bit.

To the one end of the main body housing 6, a motor 1 is mounted as a driving source. At the other end of the main body housing 6, the end bit (not shown) is detachably mounted to the end bit holder 8 for delivering rotational impact force.

On the side of the one end of the main body housing 6, a circuit board having an inverter 2 for driving the motor 1, is mounted. At intermediate positions within the main body housing 6, are mounted a power transmission system (speed reduction system) 9 for transmitting rotational power in the rotating shaft direction of the motor 1; a rotational impact system 10 for producing the rotational impact force; and an anvil 13 for transmitting the rotational impact force of the rotational impact system 10 to the end bit.

To the bottom end of the handle housing 7, a battery pack case 4 which holds a battery pack 4*a* is detachably mounted as a power source of the motor 1. Above the battery pack case 4, a circuit board having a control circuit section 3 for controlling the inverter 2 of the motor 1, extends in a direction across the figure. On the other hand, a trigger switch 15 is provided at the top end of the handle housing 7. The trigger switch 15 protrudes forward from the handle housing 7, in an urged state by a spring. As will be described later, the trigger switch 15 is depressed into the handle housing 7 against spring tension, thereby starting the motor 1. The rpm of the motor 1 is controlled by adjusting the amount of pressing the trigger switch 15.

The battery pack 4*a* is electrically connected so that power is supplied to the trigger switch 15 and the control circuit (circuit board) section 3, as well as to the inverter section 2 at the same time.

The rotational power from the rotary output shaft of the motor 1 is transmitted to a spindle 11 included in the rotational impact system 10, through the power transmission system 9 engaging with the gear teeth of the rotary output shaft. The power transmission system 9 includes a pinion gear (sun gear) 9*a*, and two planet gears 9*b* engaging with the pinion gear 9*a*. These gears are located in an inner cover (not shown) within the main body housing 6. The power transmission system 9 transmits the rotational power whose speed is reduced relative to that of the brushless direct-current motor 1, to the spindle 11.

The rotational impact system 10 includes the spindle to which rotational power is transmitted through the power transmission system 9; a hammer 12 attached to the spindle 11, engaging with the spindle 11 movably in the rotating shaft direction, for producing rotational impact force; and an anvil 13 rotated by the rotational impact force produced by the hammer 12, having the end bit holder 8. The hammer 12 has two hammer projections (percussors) 12*a*. The anvil 13 has two anvil projections 13*a*. The hammer projections 12*a* and the anvil projections 13*a* are symmetrically arranged at two positions on a plane of rotation, in a manner such that each hammer projection 12*a* and its corresponding anvil projection 13*a* engages with each other in the rotating direction.

The engagement between each projection pair of 12*a* and 13*a* transmits rotational impact force. The hammer 12 is a ling-like flame surrounding the spindle 11 so as to be slidably in contact with the spindle 11 in the shaft direction, and is in an urged state by the spring 14 forward in the shaft direction. On the inner face of the hammer 12, an inverted V-shaped (generally triangle) cam groove 12*b* is formed. On the other hand, on the periphery of the spindle 11, a V-shaped cam groove 11*a* is formed in the shaft direction. A ball (steel ball) 17 is inserted between the cam groove 11*a* and the cam groove 12*b* formed on the inner face of the hammer 12 so that the hammer 12 through the ball.

FIG. 2 shows the relation between a schematic operation of the rotational impact system 10 and a motor rpm, in which (A) shows a state that the hammer 12 moves backward and has left the projections 13*a* of the anvil 13; (B) shows a state that the hammer 12 rotatingly moves toward the projections 13*a* of the anvil 13, urged by a not shown spring, from the backward position; and (C) shows a state immediately before the hammer 12 goes into engagement between the projections 12*a* of the hammer 12 and the projections 13*a* of the anvil 13 in order to give a rotational impact force to projections 13*a* of the anvil 13 by the tension of the spring.

In the rotational impact system 10, if the torque produced between a workpiece and a clamping part such as a screw, is not high excessively, the rotational power of the spindle 11 given by the motor 1 is transmitted to the hammer 12 through the ball 17 held between the cam groove 11*a* of the spindle 11 and the cam groove 12*b* of the hammer 12. As a result, the spindle 11 and the hammer 12 start rotating together. The spindle 11 and the hammer 12 are twisted relative to each other. The hammer 12 twistingly compresses the spring 14 along the cam groove 11*a* of the spindle while moving backward (direction of the arrow shown in (A) of FIG. 2). After the hammer projections 12*a* leave the combination with the corresponding anvil projections 13*a*, when the hammer 12 gets over the height of the anvil projections 13*a*, the hammer 12 go out of the engagement with the anvil 13 (state shown in (A) of FIG. 2). In this case, the motor rotates at minimum speed among states in which the hammer 12 is out of the engagement with the anvil 13. Furthermore, the hammer 12 rotatingly moves forward, urged by the spring 14 and guided by the cam groove 11*a* (state shown in (B) of FIG. 2). The hammer projections 12*a* give impact torque to the anvil projections 13*a* of the anvil 13 positioned in front of each hammer projection 12*a* in the rotating direction (state shown in (C) of FIG. 2). The impact torque is transmitted to the driver bit attached to the end bit holder 8 of the anvil 13. The driver bit then transmits the impact torque to the clamping screw, thereby tightening the screw into the workpiece or clamping the workpiece. This means that the hammer projections 12*a* and the anvil projections 13*a* move into engagement again. After that, the hammer 12 starts moving backward again, thereby repeating the above-described impact operation.

Referring next to FIG. 3, the inverter circuit section of the motor 1 and the control circuit section 3 are described.

In this mode, the motor 1 is a three-phase brushless direct-current motor. The motor 1 includes an inner rotor 1*b* having a permanent magnet including one pair of north and south poles, embedded therein; three rotational position detectors (hall ICs) 5*a*, 5*b*, and 5*c* arranged at intervals of 60°, for detecting the rotational position of the magnet rotor 1*b*; and an armature winding 1*d* having three-phase windings U, V, and W of a star-connected stator 1*c*, controlled to become a current application section of an electric angle of 120° based on position detection signals from the rotational position detectors 5*a*, 5*b*, and 5*c*. In this mode, the motor 1 detects the position of the rotor 1*b* by using the hall ICs in an electromagnetic coupling manner. However, the rotor position can also be detected sensorlessly by extracting the induced electromotive voltage (counter electromotive force) of the stator winding 1*d* as logical signals, through a filter.

The inverter circuit section (power converter) 2 includes six, three-phase bridge-connected FETs (hereinafter, referred to as "transistors") Q1-Q6; and a flywheel diode (not shown). Each gate of the bridge-connected transistors Q1-Q6 is connected to a control signal output circuit 37. Either source or drain of each of the six transistors Q1-Q6 is connected to one of the star-connected armature windings U, V, and W. A switching element driving signal is inputted from the control signal output circuit 37 so that the six transistors Q1-Q6 perform a switching operation. As a result, power is supplied to the armature windings U, V, and with the direct-current voltage of the battery pack 4*a* applied to the inverter 2 as three-phase (U-phase, V-phase, and W-phase) voltages Vu, Vv, and Vw.

The control circuit section 3 includes an operation unit 31, a current detection circuit 32, an applied voltage setting circuit 33, a rotating direction setting circuit 34, a rotational position detection circuit 35, a rotational speed detection circuit 36, and a control signal output circuit 37. The operation unit 31, although not shown, has a microcomputer which includes a CPU for outputting driving signals based on processing programs and data; a ROM for storing programs and control data corresponding to flowcharts to be described later; a RAM for storing data temporarily; and a timer. The current detection circuit 32 detects the motor current flowing through the motor 1. The detected current is inputted to the operation unit 31.

The applied voltage setting circuit 33 sets the voltage to be applied to the motor 1, specifically, the duty ratio of a PWM signal, in response to the amount of the pressure applied by the trigger switch 15. The rotating direction setting circuit 11 sets the rotating direction of the motor 1 by detecting an operation of rotating the motor in either forward or reverse direction performed through a forward-reverse switching lever 16. The rotational position detection circuit 35 detects the positions of the rotor 1*b* and the stator 1*c*, relative to the armature windings U, V, and W, based on signals outputted from the three rotational position detectors 5*a*, 5*b*, and 5*c*. The rotational speed detection circuit 36 detects the rpm of the motor, based on the number of detection signals from the rotational position detection circuit 35, counted per unit time.

The control signal output circuit 37 transmits PWM signals to the transistors Q1-Q6 positioned on the power source side, based on the output from the operation unit 31. The pulse width of each PWM signal is controlled so that power to be supplied to each of the armature windings U, V, and W is adjusted, thereby controlling the rpm of the motor 1 in the preset rotating direction.

Figure 4:
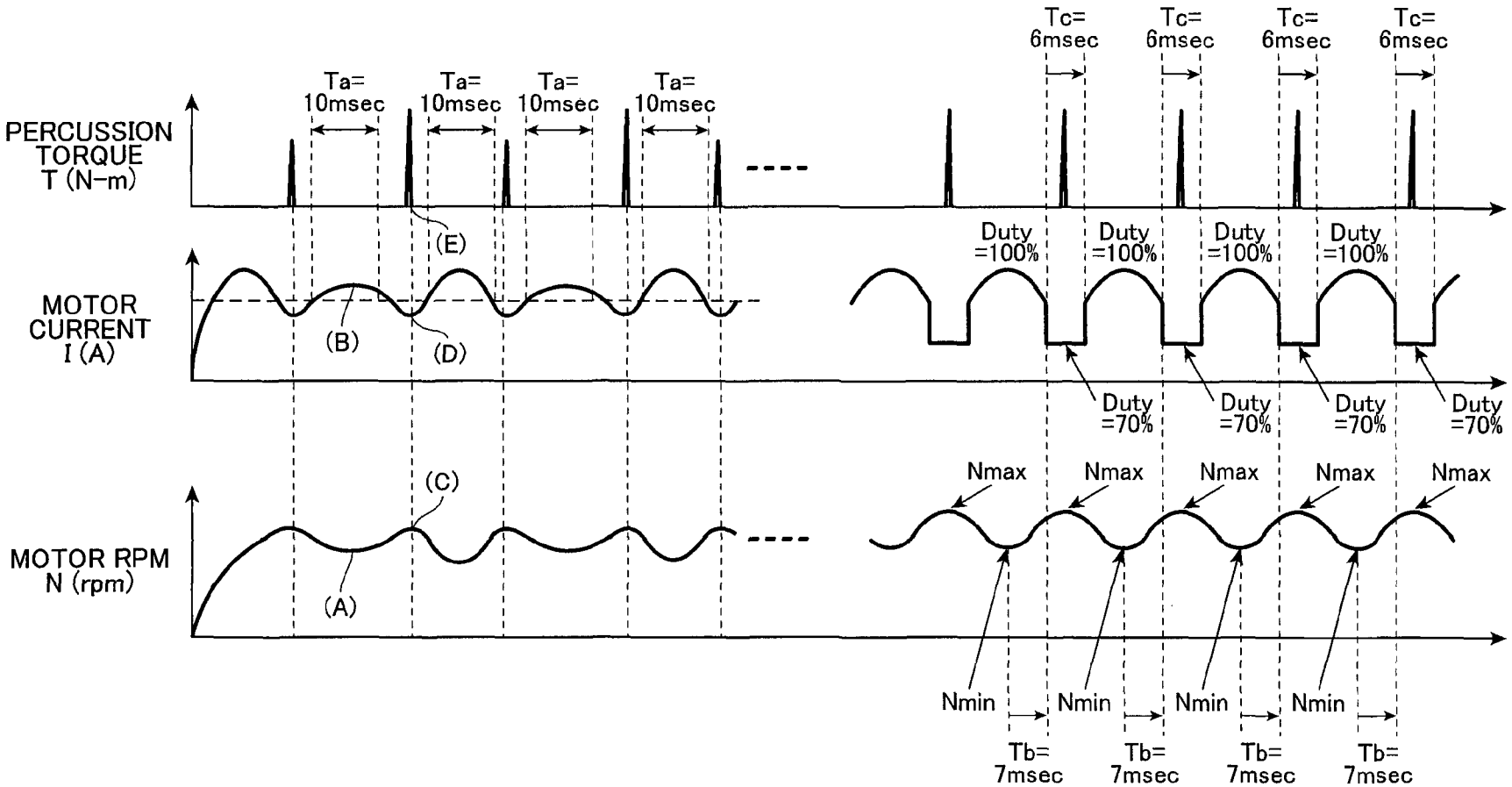
FIG. 4 is a time chart showing various characteristics when a drive control according to a first embodiment of the present invention is performed.
Figure 5A:
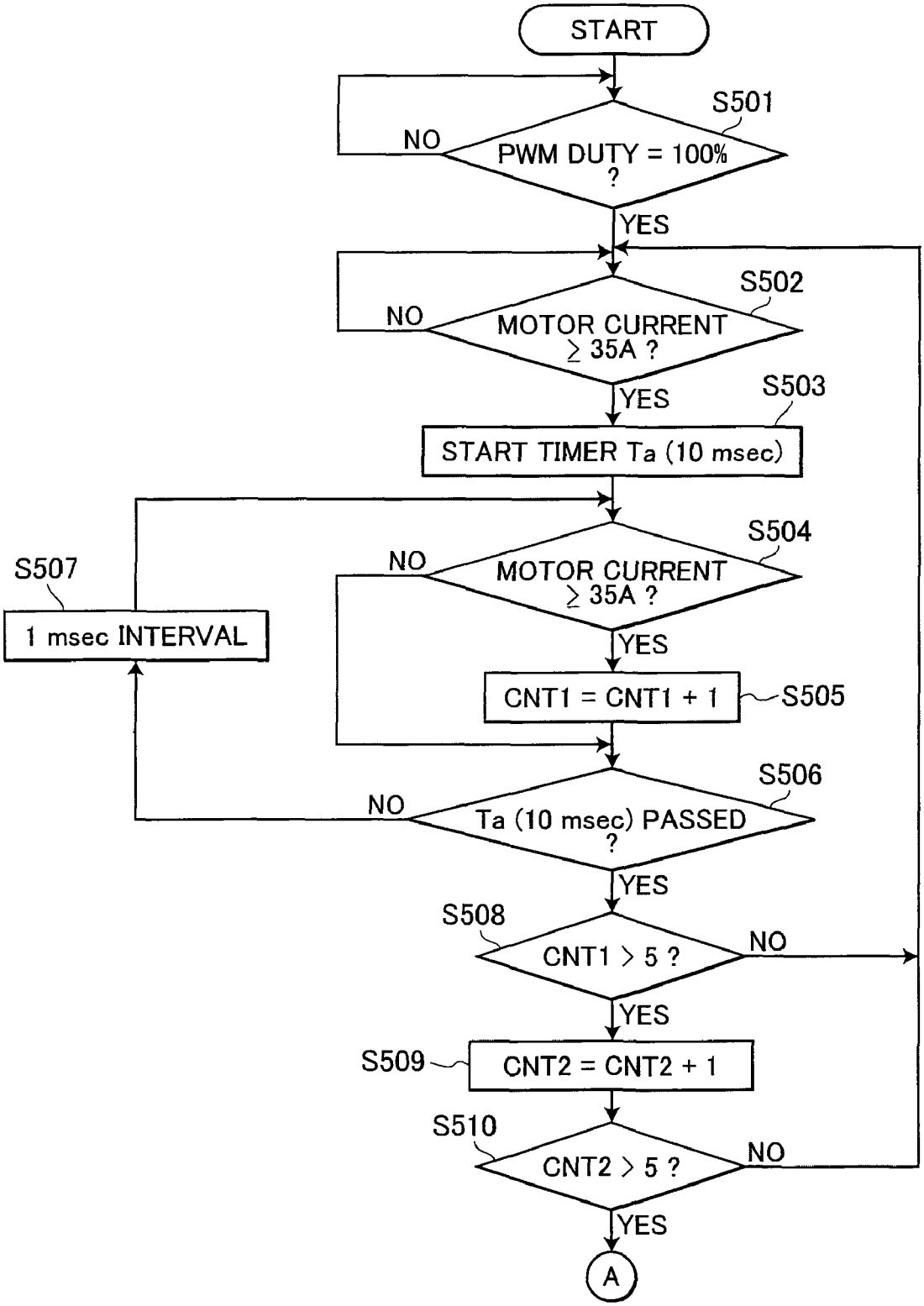
FIG. 5A is a flowchart illustrating the drive control according to the first embodiment of the present invention.
Figure 5B:
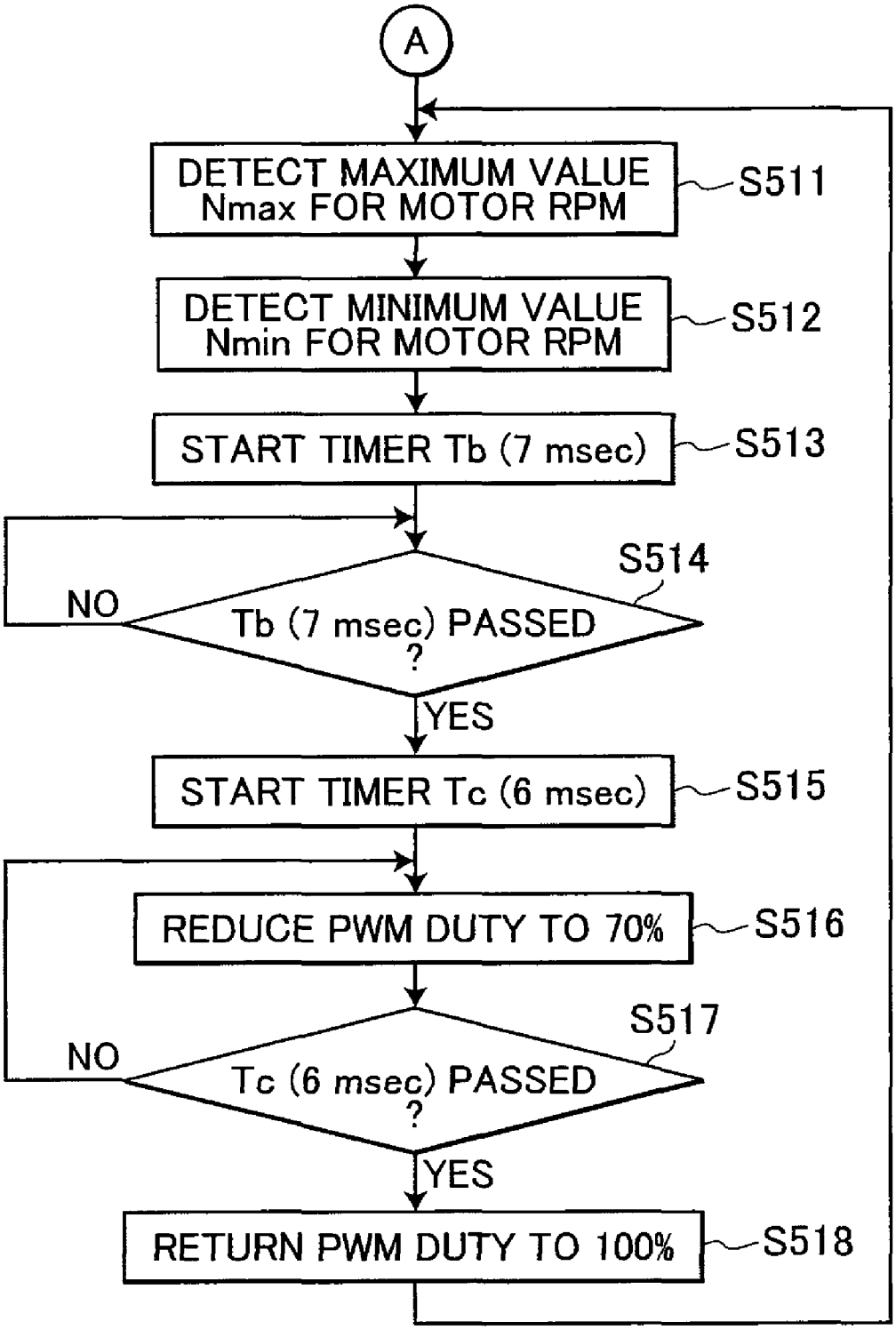
FIG. 5B is a flowchart to be continued to the flowchart shown as FIG. 5A.

Referring next to FIGS. 4, 5A and 5B, a description is given for the control of an impact driver 100 according to a first mode. FIG. 4 is a time chart showing the relation between an impact torque T, a motor current I, and a motor rpm N. FIG. 5A and FIG. 5B are flowcharts showing the control of reducing the rpm of the motor 1 before and after the impact by the hammer 12.

Referring first to FIGS. 2 and 4, the relation between an impact torque, a motor current, and a motor rpm, is described.

As the hammer 12 goes into engagement with the anvil projections 13*a* of the anvil 13, the load applied to the motor 1 reaches a maximum. As shown in FIG. 4, the rpm N of the motor 1 reaches a minimum ((A)) in the result. On the other hand, since the load applied to the motor 1 reaches a maximum, the motor current I reaches a maximum ((B)). After that, as the hammer 12 gets on the anvil projections 13*a* of the anvil 13, the load applied in the rotating direction of the motor 1 is reduced. The hammer 12 then gets over the anvil projections 13*a* of the anvil 13, to go out of the engagement with the anvil 13 ((A) and (B) of FIG. 2). In this case, the load applied to the motor 1 reaches a minimum, and the rpm N of the motor 1 reaches a maximum ((C)). On the other hand, since the load applied to the motor 1 reaches a minimum, the motor current I reaches a minimum ((D)). The moment the rpm N of the motor 1 reaches a maximum with the motor current I reaching a minimum, the hammer 12 performs an impact motion ((E)).

If a motor having a large drive power, such as a brushless motor, is employed in this case, the impact by the hammer is too strong. When the hammer gets on the anvil projections, the hammer moves backward to an excessive degree. This may cause the hammer to crash into the opposite wall, thereby breaking the wall. In order to prevent such a situation, the rpm of the motor 1 is reduced before and after the impact by the hammer 12 in this mode.

Referring to the flowcharts of FIGS. 5A and B, in S501, the CPU determines whether or not the PWM duty of the motor control is 100%. This is because the hammer 12 usually moves backward to an excessive degree when the trigger switch 15 is depressed to the fullest extent, specifically, when the PWM duty cycle is 100%.

If the PWM duty cycle is not 100% (S501: NO), the CPU continues to determine whether or not the PWM duty cycle is 100%. If the PWM duty is 100% (S501: YES), the CPU determines whether or not the motor current I is 35 A or larger in S502. In this mode, a threshold value is set to 35 A, which may cause the hammer 12 to move backward to an excessive degree. However, another value can be employed as the threshold value.

If the motor current I is smaller than 35 A (S502: NO), the CPU continues to determine whether or not the motor current I is 35 A or larger. If the motor current I is 35 A or larger (S502: YES), the CPU starts the timer for a time period Ta (10 msec) in S503 (see FIG. 4). In S504, the CPU determines again whether or not the motor current I is 35 A or larger.

If the motor current I is 35 A or larger (S504: YES), the CPU counts up a CNT 1 in S505. In S506, the CPU determines whether or not the time period Ta (10 msec) has passed. If the motor current I is smaller than 35 A (S504: NO), the CPU determine whether or not the time period Ta (10 msec) has passed, without counting up the CNT 1 in S506. In this manner, the number of times the motor current I is equal to the threshold value 35 A or larger, is counted, detected within a predetermined period of time (10 msec in this mode).

If the time period Ta (10 msec) has not passed yet (S506: NO), the CPU returns to S504 after a time interval of 1 msec in S507. In S504, the CPU again determines whether or not the motor current I is 35 A or larger. If the time period Ta (10 msec) has passed (S506: YES), the CPU determine whether or not the number counted up by the CNT 1 is larger than 5 in S508.

If the number counted up by the CNT 1 is 5 or smaller (S508: NO), the CPU returns to S502. In S502, the CPU again determines whether or not the motor current I is 35 A or larger. If the number counted up by the CNT 1 is larger than 5 (S508: YES), the CPU counts up a CNT 2 in S509. In S510, the CPU determines whether or not the number counted up by the CNT 2 is larger than 5. If the number counted up by the CNT 2 is 5 or smaller (S510: NO), the CPU returns to S502. In S502, the CPU again determines whether or not the motor current I is 35 A or larger. After the determination five times in S508, that the motor current I detected in S503 to S507 becomes equal to or exceeds the threshold value 35 A more than five times in total, the CPU starts the control of reducing the rpm of the motor 1.

If the number counted up by the CNT 2 is larger than 5 (S510: YES), the CPU decides the maximum value Nmax for the motor rpm N in S511 (see FIG. 4). In this mode, the CPU detects the motor rpm N per 1 msec. If a detected result is larger than the previous detected result, the CPU updates the maximum value. The CPU employs the updated value after four detection operations as the maximum value Nmax. As a result, the CPU detects the moment when the impact by the hammer 12 occurs.

In S512, the CPU decides a minimum value Nmin for the motor rpm N (see FIG. 4). In this mode, the CPU detects the motor rpm N per 1 msec. If a detected result is smaller than the previous detected result, the CPU updates the minimum value. The CPU employs the updated minimum value after four detection operations as a minimum value Nmin. As a result, the CPU detects the moment when the hammer 12 combines with the anvil projections 13*a*, specifically, the moment immediately before the hammer 12 gets on the anvil projections 13*a*.

In S513, the CPU starts the timer for a time period Tb (7 msec). In S514, the CPU determines whether or not the time period Tb (7 msec) has passed (see FIG. 4). If the time period Tb (7 msec) has not passed yet (S514: NO), the CPU continues to determine whether or not the time period Tb (7 msec) has passed. In this case, the time period Tb (7 msec) is not limited to 7 msec as long as the time period Tb is shorter than the time period after the moment when the hammer 12 engages with the anvil projections 13*a*, until the moment the impact by the hammer 12 occurs. As a result, the motor 1 is driven with a PWM duty cycle of 100% until the moment a little before the impact by the hammer 12 occurs.

If the Tb (7 msec) has passed (S514: YES), the CPU starts the timer for a time period Tc (6 msec) in S515. In S516, the CPU reduces the PWM duty cycle to 70% (see FIG. 4). In this case, the time period Tc (6 msec) is not limited to 6 msec as long as the time period Tc includes the moment when the impact by the hammer 12. As a result, the motor 1 is driven with a PWM duty cycle of 70% before and after the moment when the impact by the hammer 12 occurs.

After that, the CPU determine whether or not the time period Tc (6 msec) has passed in S517 (see FIG. 4). If the time period Tc (6 msec) has not passed yet (S517: NO), the CPU continues to determine whether or not the time period Tc (6 msec) has passed. If the time period Tc (6 msec) has passed (S517: YES), the CPU returns the PWM duty cycle to 100% in S518.

This configuration reduces the PWM duty cycle of the motor control, specifically, reduces the rpm of the motor 1, before and after the moment when the impact by the hammer 12 occurs. As a result, the configuration prevents the impact by the hammer 12 from being excessive, thereby preventing the hammer 12 from moving backward to an excessive degree to crash into the opposite wall. Further, since the PWM duty cycle is reduced when the number at which the current value exceeds a predetermined value is equal to or greater than a predetermined number, the excessive impact by the spindle can be prevented reliably from occurring. Further, since the PWM duty cycle is reduced after the minimum value of the motor rpm is detected, the time at which the impact occurs can be detected reliably.

Mode for the Invention 2

Figure 6:
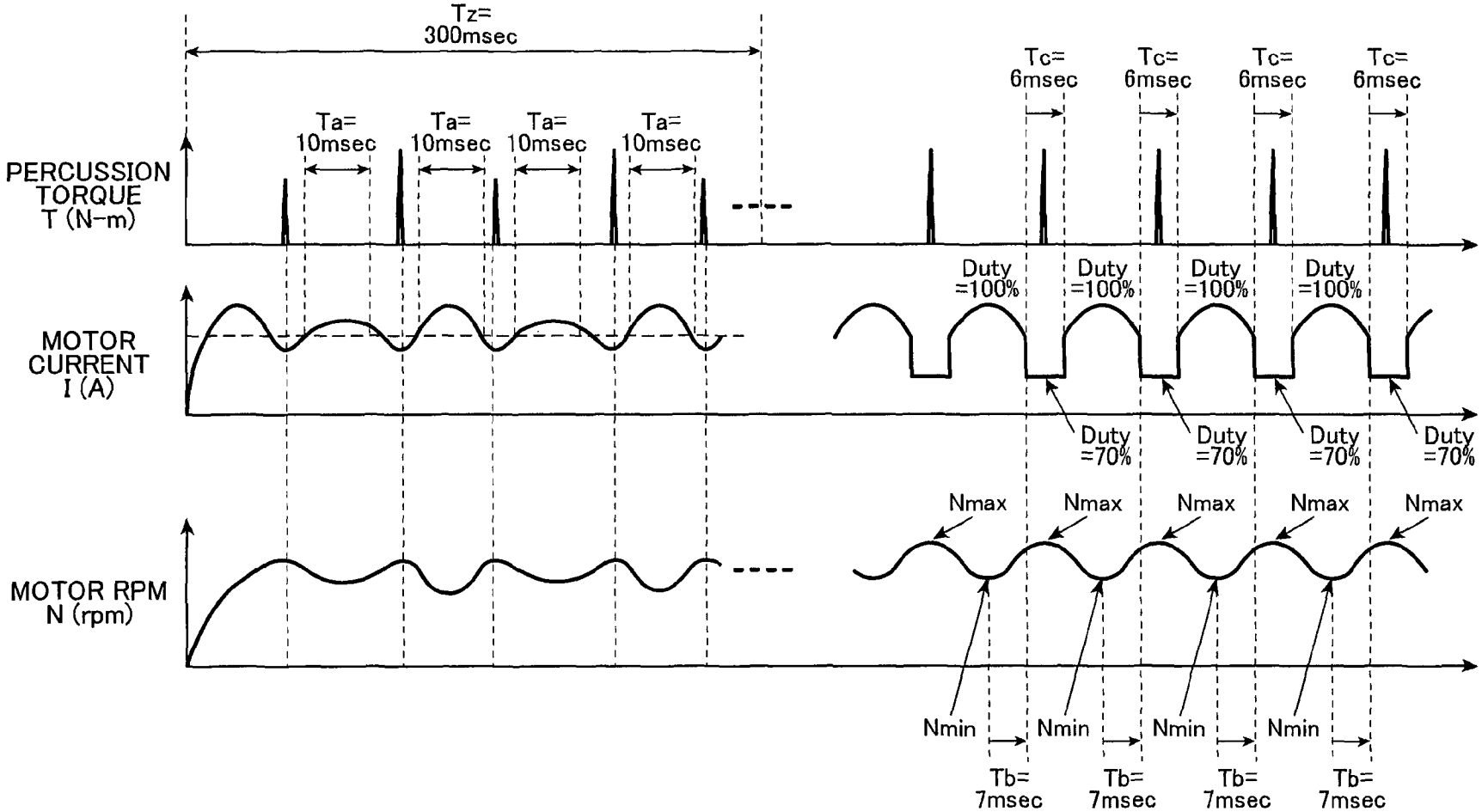
FIG. 6 is a time chart showing various characteristics when a drive control according to a second embodiment of the present invention is performed.
Figure 7A:
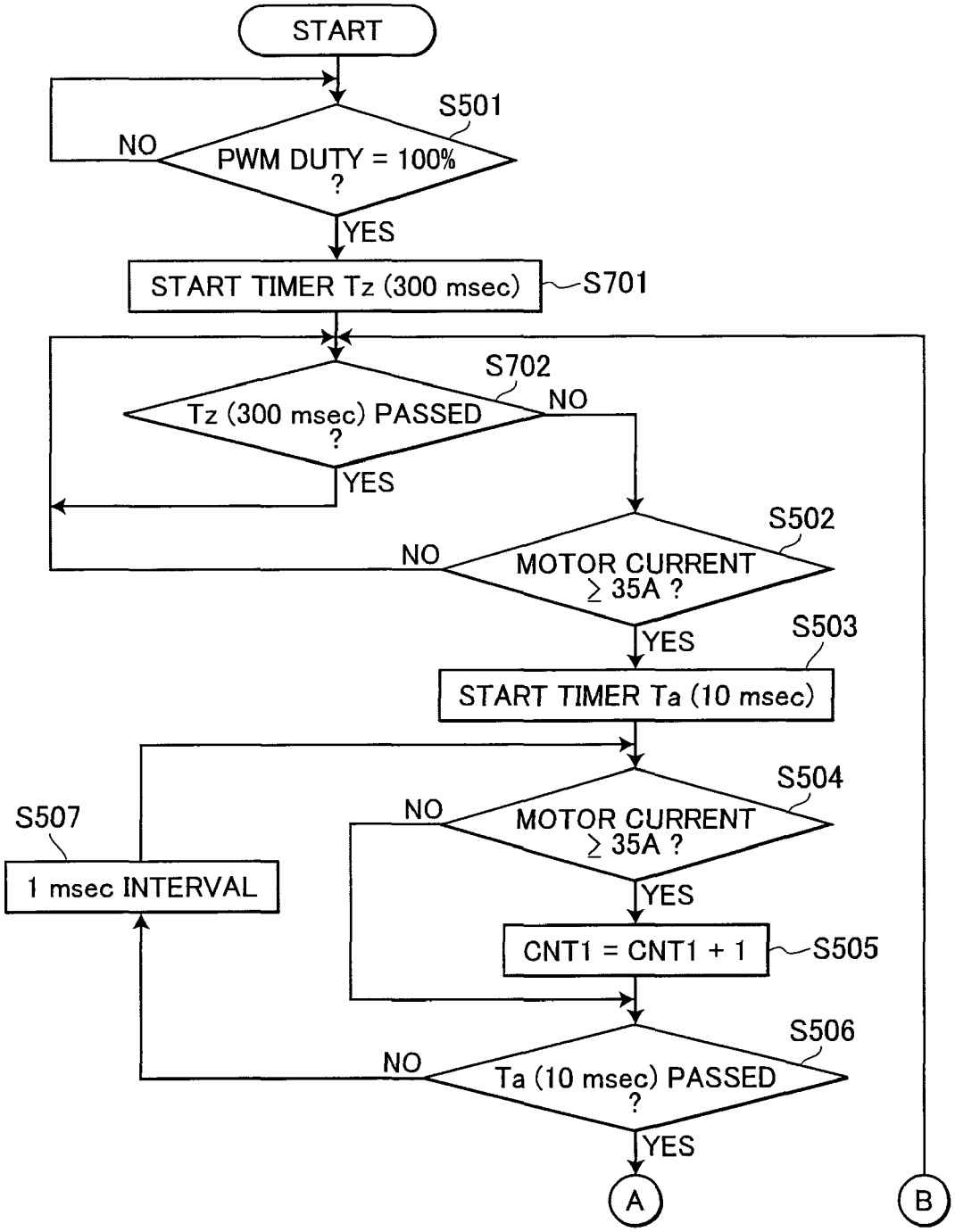
FIG. 7A is a flowchart illustrating the drive control according to the second embodiment of the present invention.
Figure 7B:
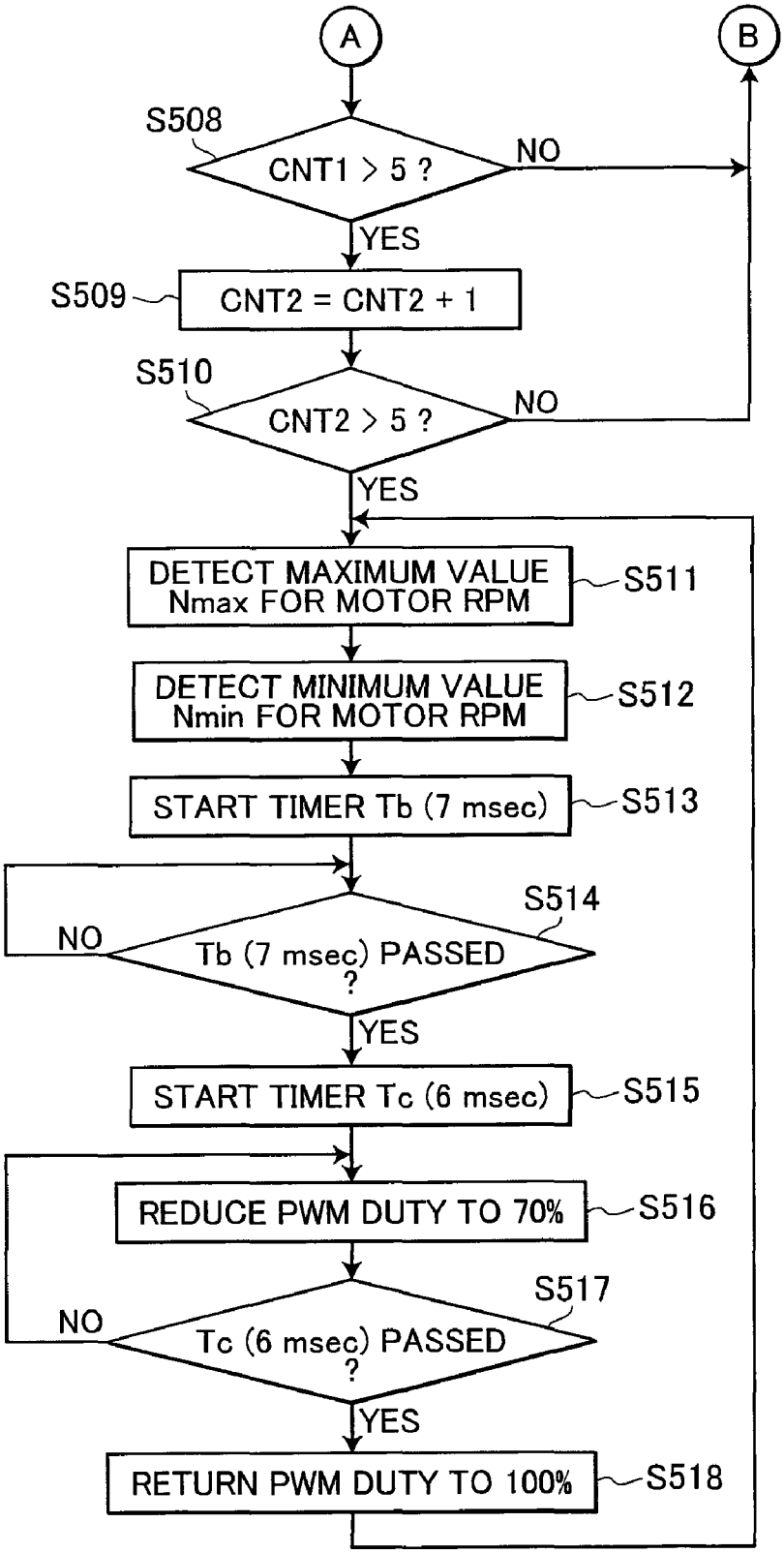
FIG. 7B is a flowchart to be continued to the flowchart shown as FIG. 7A.

Referring next to FIGS. 6, 7A and 7B, a description is given for the control of an impact driver 100 according to a second mode of the present invention. FIG. 6 are time charts showing the relation between an impact torque T, a motor current I, and a motor rpm N. FIGS. 7A and 7B are flowcharts showing the control of reducing the rpm of the motor 1 before and after the impact by the hammer 12. In FIGS. 7A and 7B, the steps which are the same as in the flowcharts of FIGS. 5A and 5B have the same reference numbers. A description is given only for different steps here.

In the second mode, after determining that the PWM duty cycle is 100% in S501 of FIG. 7A, the CPU starts the timer for a time period Tz (300 msec) in S701 (see FIG. 6). After that, the CPU determines whether or not the time period Tz (300 msec) has passed in S702. If the time period Tz (300 msec) has not passed yet (S702: NO), the CPU proceeds to S502 to perform the control described in FIGS. 5A and 5B. If the CPU determines that the number counted up by the CNT 2 is 5 or smaller in S510, the CPU returns to S702 to determine whether or not the time period Tz (300 msec) has passed. On the other hand, if the CPU determines that the time period Tz (300 msec) has passed (S702: YES), the CPU continues to determine whether or not the time period Tz (300 msec) has passed. The control described in FIG. 5A and FIG. 5B is not performed later in this mode.

Thus, in the second mode, if the CPU does not start the control of reducing the rpm of the motor 1 within a predetermined period of time (300 msec in this mode), the CPU does not perform the control of reducing the rpm of the motor 1 later in the process, either. For example, if a driver is employed as the end bit, a screw is to be tightened into a wooden board or the like. Therefore, if the rpm of the motor 1 is reduced during the screwing operation, the screw is likely not to reach the right position therefor. However, in the second mode, if the CPU does not start the control of reducing the rpm of the motor 1 within the predetermined period of time, the CPU does not perform the control of reducing the rpm of the motor 1 later in the process, either. As a result, a screw is securely tightened in a wooden board or the like.

Mode for the Invention 3

Figure 8:
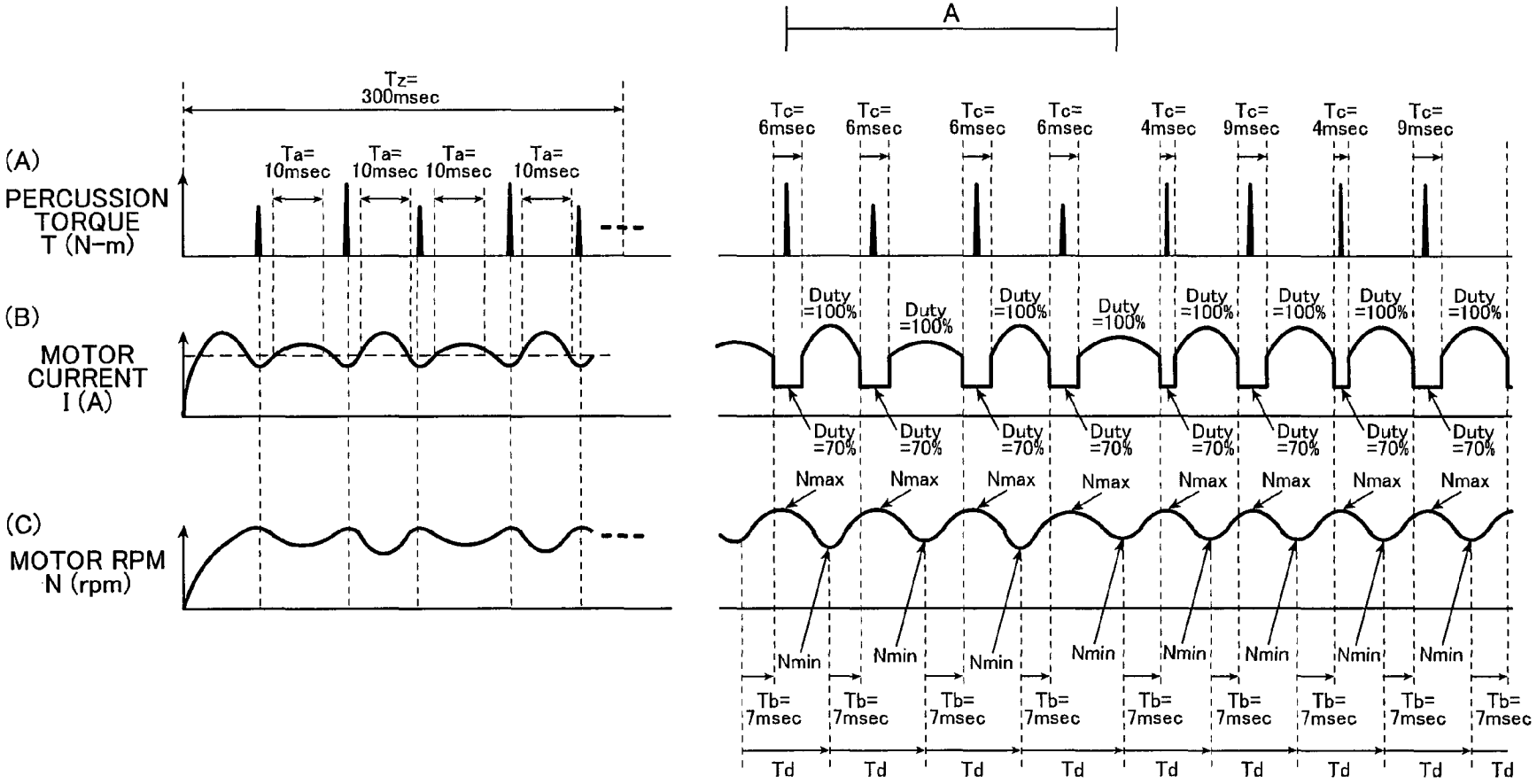
FIG. 8 is a time chart showing various characteristics when a drive control according to a third embodiment of the present invention.
Figure 9A:
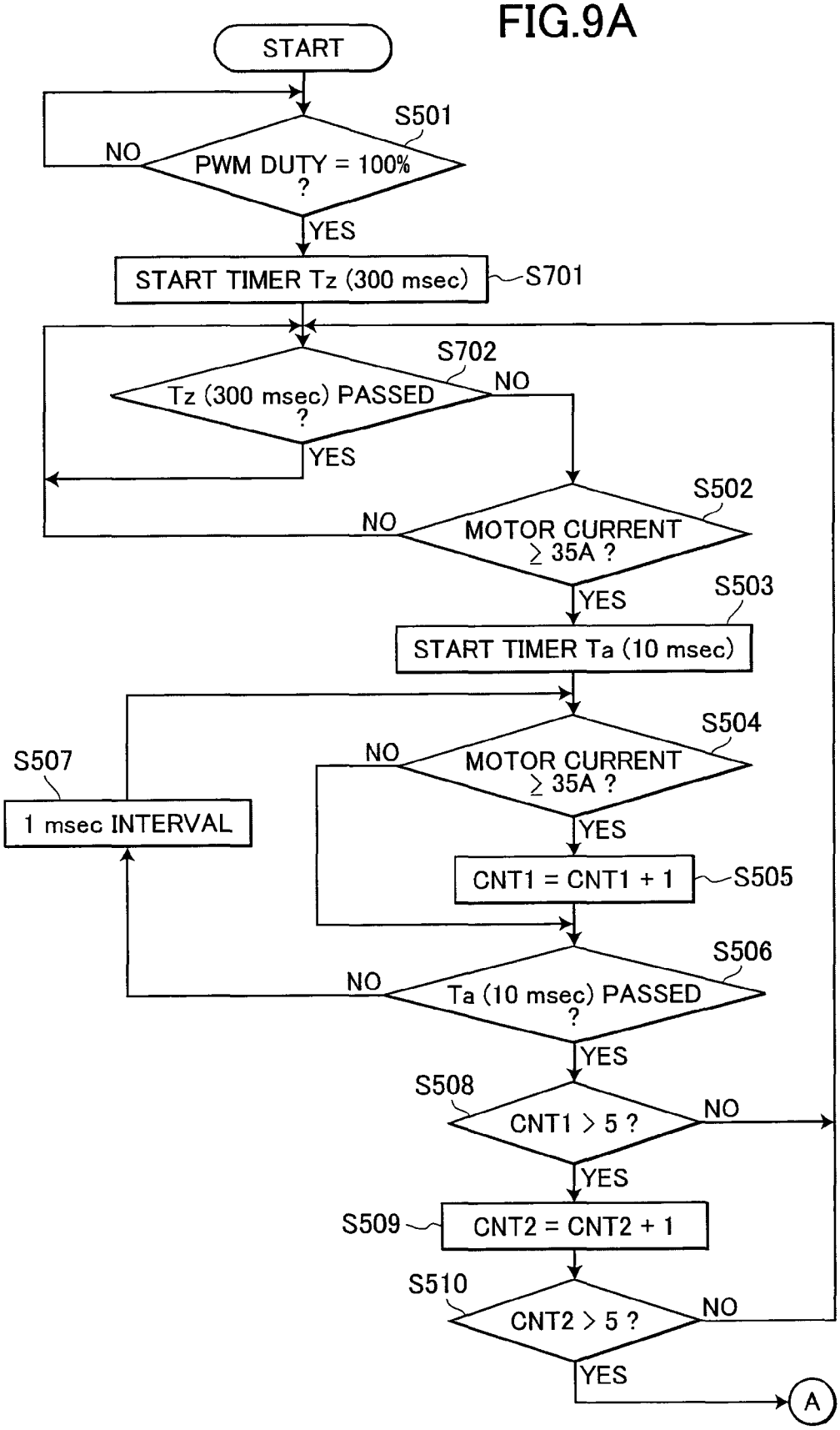
FIG. 9A is a flowchart illustrating the drive control according to the third embodiment of the present invention.
Figure 9B:
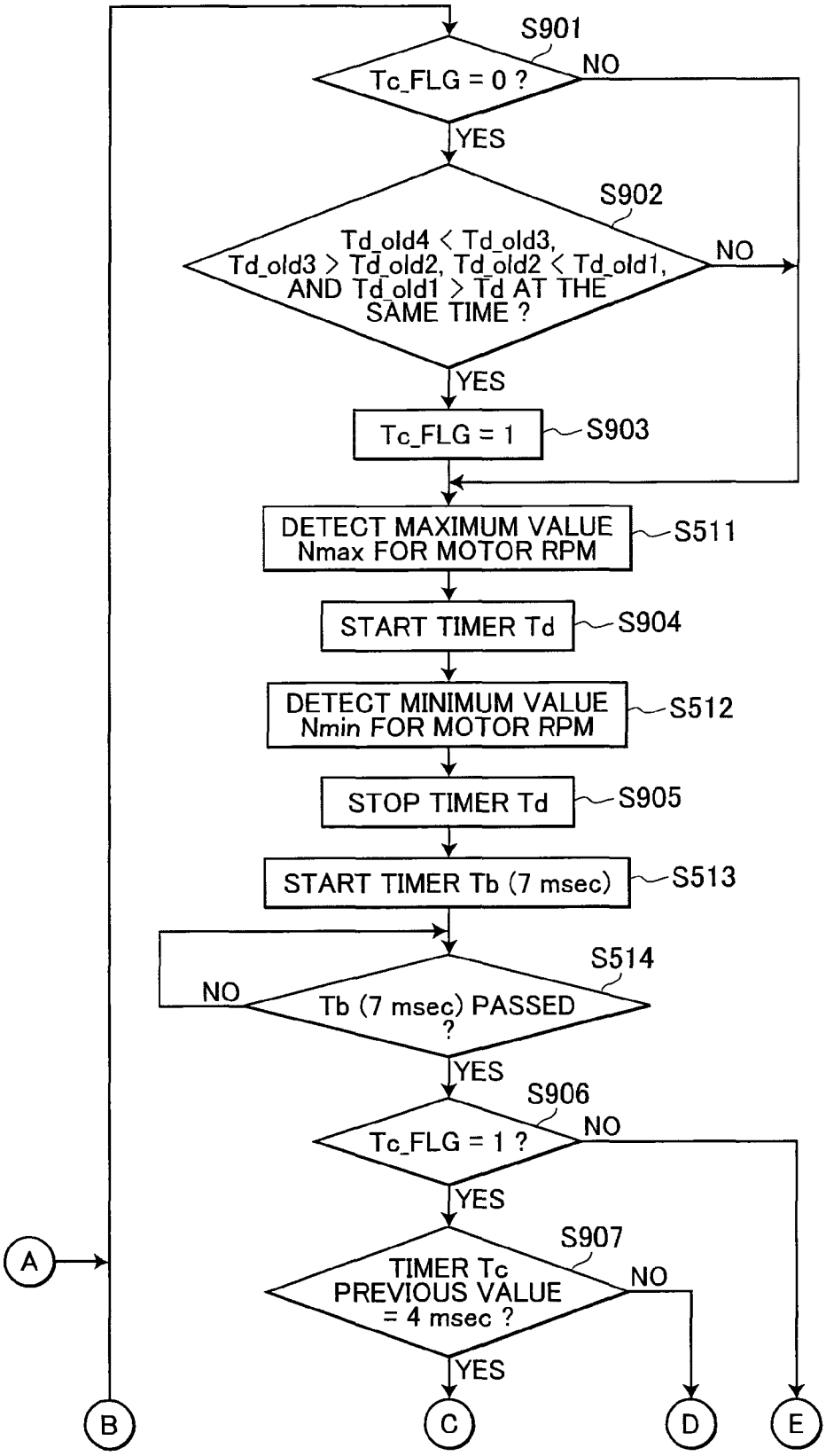
FIG. 9B is a flowchart to be continued to the flowchart shown as FIG. 9A.
Figure 9C:
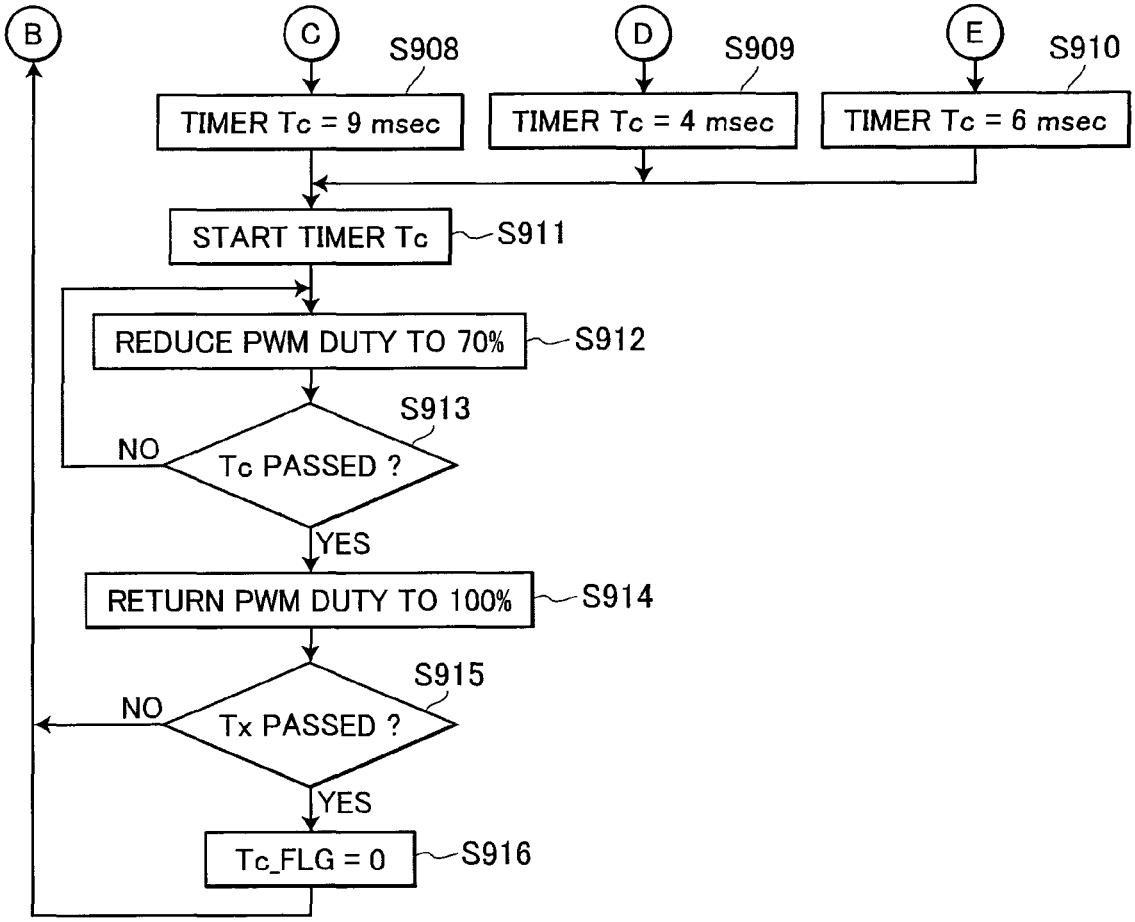
FIG. 9C is a flowchart to be continued to the flowchart shown as FIG. 9B.

Referring next to FIGS. 8 and 9A to 9C, a description is given for the control of an impact driver 100 according to a third mode of the present invention. FIG. 8 are time charts showing the relation between an impact torque T, a motor current I, and a motor rpm N. FIG. 9A to FIG. 9C are flowcharts showing the control of reducing the rpm of the motor 1 before and after the impact by the hammer 12. In FIG. 9A to FIG. 9C, the steps which are the same as in the flowcharts of FIGS. 7A and 7B have the same reference numbers. A description is given only for different steps here.

In the third mode, after determining that the number counted up by the CNT 2 is larger than 5 in S510 of FIG. 9A, the CPU determines whether or not a Tc flag meaning that the time intervals of the impact by the hammer 12 are longer and shorter alternatively, as shown in FIG. 8A is zero in S901. If the Tc flag is zero (S901: YES), the CPU determines whether or not Td_old4<Td_old3, Td_old3>Td_old2, Td_old2<Td_old1, and Td_old1<Td at the same time in S902. In this case, the Td_old4, the Td_old3, the Td_old2, and the Td_old1 mean Tds one to four cycles before, respectively. The term Td is described later.

If Td_old4<Td_old3, Td_old3>Td_old2, Td_old2<Td_old1, and Td_old1<Td at the same time (S902: YES), the CPU sets the Tc flag to one in S904. After that, the CPU decides the maximum value Nmax for the motor rpm N in S511. If NO in S901 or S902, the CPU proceeds straight to S511 to decide a maximum value Nmax for the motor rpm N.

Specifically, only when Td_old4<Td_old3, Td_old3>Td_old2, Td_old2<Td_old1, and Td_old1<Td at the same time in a state that the Tc flag has been originally set to zero, the CPU sets the Tc flag to one.

After deciding the maximum value Nmax for the motor rpm N in S511, the CPU starts the timer in S904. The CPU then decides a minimum value Nmin for the motor rpm N in S512. While deciding the minimum value Nmin for the motor rpm N, the CPU stops the timer from counting, and stores the counted value Td in S905. Specifically, the counted value Td means the period of time lapsed after the maximum value Nmax of the motor rpm N until the minimum value Nmin thereof. The Td thus stored is used for making the determination in S902. Therefore, the situation of S902 "Td_old4<Td_old3, Td_old3>Td_old2, Td_old2<Td_old1, and Td_old1<T at the same time" means that the time intervals of the impact by the hammer 12 are longer and shorter alternatively, as shown in FIG. 8A.

If the CPU determines that the time period Tb (7 msec) has passed in S513 and S514, the CPU determines whether or not the Tc flag is one in S906. If the Tc flag is one (S906: YES), the CPU determines whether or not the previous value of the Tc is 4 msec in S907. If the previous value of the Tc is 4 msec (S907: YES), the CPU sets the time period Tc to 9 msec in S908, and then starts the timer in S911. On the other hand, if the previous value of the Tc is not 4 msec (S907: NO), the CPU sets the time period Tc to 4 msec in S909, and then starts the timer in S911.

If the Tc flag is not one (S906: NO), the CPU sets the time period Tc to 6 msec in S910, and then starts the timer in S911. In S912, the CPU reduces the PWM duty cycle to 70% at the same time as the timer starts in S911. After that, in S913, the CPU determines whether or not the time period Tc has passed.

If the time period Tc has not passed yet (S913: NO), the CPU continues to determine whether or not the time period Tc has passed. If the time period Tc has passed (S913: YES), the CPU returns the PWM duty cycle to 100% in S914. In S915, the CPU determines whether or not a time period Tx has passed. If the time period Tx has not passed yet (S915: NO), the CPU returns to S901 to determine again whether or not the Tc flag is zero. If the time period Tx has passed (S915: YES), the CPU sets the Tc flag to zero in S916, then return to S901.

In this mode, as described above, based on the past increase-decrease pattern of the Td (impact intervals), the Td subsequent to the past Td is predicted. The subsequent Td is controlled to have even impact intervals. Therefore, even when the impact by the hammer 12 occurs at uneven intervals, the intervals can be corrected. This configuration prevents the impact by the hammer 12 from being excessive, thereby preventing the hammer 12 from moving backward to an excessive degree to crash into the opposite wall.

Mode for the Invention 4

Figure 10:
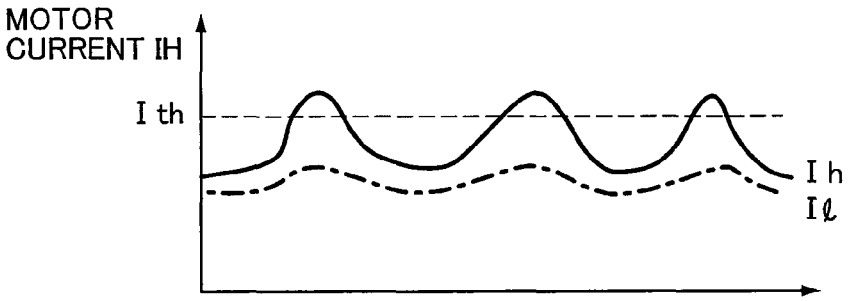
FIG. 10 is a time chart showing the relation between a motor current Ih under high load, a motor current Il under low load, and a threshold current Ith.
Figure 11:
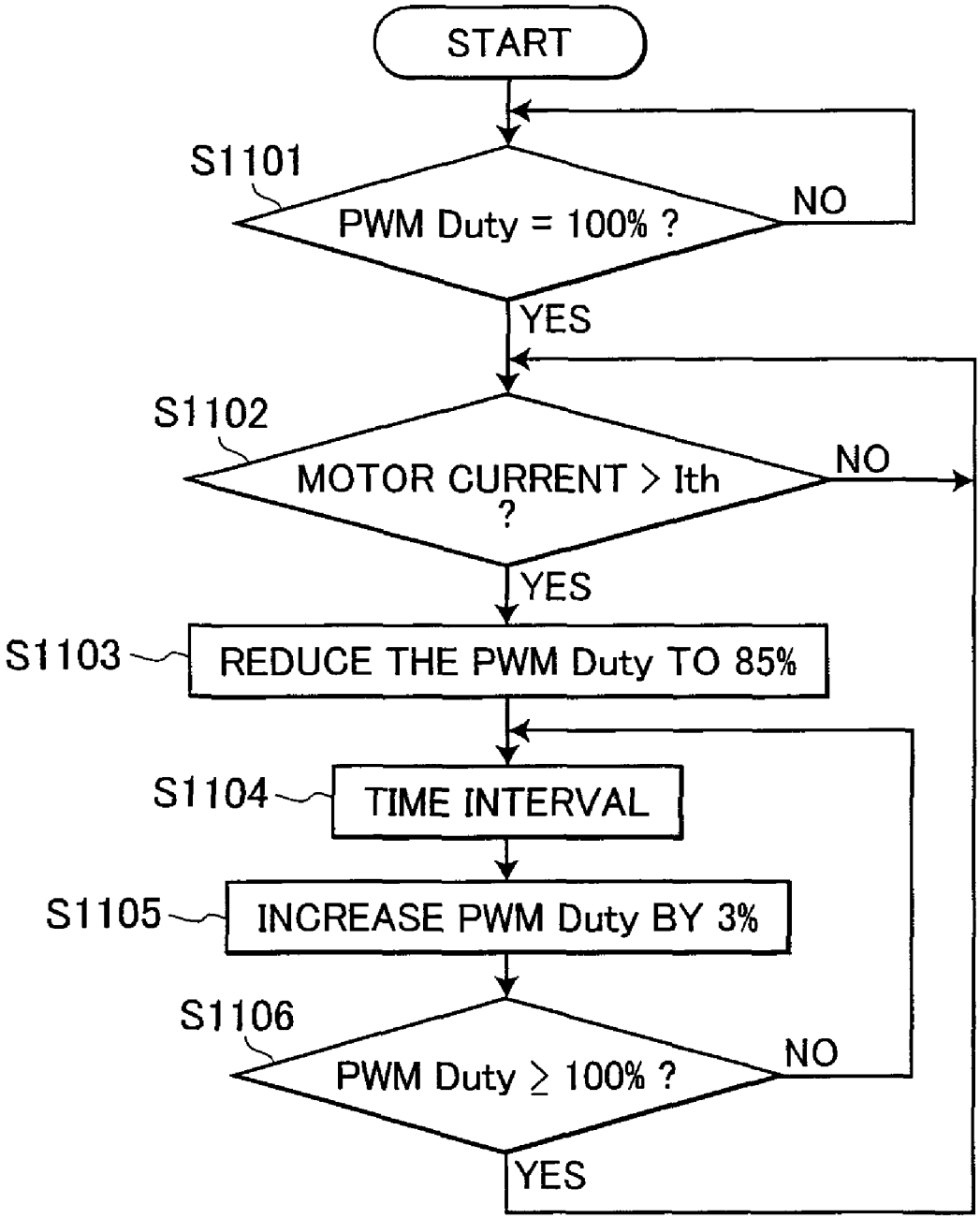
FIG. 11 is a flowchart illustrating the drive control according to a fourth embodiment of the present invention.

Referring next to FIGS. 10 and 11, a description is given for the control of an impact driver 100 according to a fourth mode of the present invention. FIG. 10 is a time chart showing the relation between a motor current Ih under high load, a motor current Il under low load, and a threshold current Ith. FIG. 11 is a flowchart showing the control of reducing the motor current I when the motor current I exceeds the threshold current Ith. In this mode, the motor current I is reduced when the motor current I exceeds the threshold current Ith, like the motor current lh under high load shown in FIG. 10.

Referring to the flowchart of FIG. 11, in S1101, the CPU determines whether or not the PWM duty cycle of the motor control is 100%. This is because the hammer 12 usually moves backward to an excessive degree when the trigger switch 15 is depressed to the fullest extent, specifically, when the PWM duty cycle is 100%.

If the PWM duty cycle is not 100% (S1101: NO), the CPU continues to determine whether or not the PWM duty cycle is 100%. If the PWM duty cycle is 100% (S1101: YES), the CPU determines whether or not the motor current I is 35 A or larger in S1102. In this mode, the threshold current Ith is set to 35 A, which may cause the hammer 12 to move backward to an excessive degree. However, another value can be employed as the threshold current Ith.

If the motor current I is smaller than 35 A (S1102: NO), the CPU continues to determine whether or not the motor current I is 35 A or larger. If the motor current I is 35 A or larger (S1102: YES), the CPU reduces the PWM duty cycle to 85% in S1103. As a result, the motor 1 is driven with a PWM duty cycle of 85%.

After a time interval (3 msec) as a sampling time for controlling the operation unit 31 (S1104), the CPU increases the PWM duty cycle by 3% in S1105. In S1106, the CPU determine whether or not the PWM duty cycle is 100% or larger. Although the PWM duty cycle never exceeds 100% in practice, the CPU determine whether or not the PWM duty cycle is 100% or larger on calculation in the operation unit 31.

If the PWM duty cycle is smaller than 100% (S1106: NO), the CPU returns to S1104. After the time interval, the CPU increases the PWM duty cycle by 3% again in S1105. If the PWM duty cycle is 100% or larger (S1106: NO), this means that the PWM duty cycle has been set to 100%. The CPU returns to S1102 to determine again whether or not the motor current I is 35 A or larger.

In this configuration, if the motor current 1 exceeds the threshold current Ith, the CPU reduces the motor current I. As a result, this configuration prevents the impact by the hammer 12 from being excessive, thereby preventing the hammer 12 from moving backward to an excessive degree, to crash into the opposite wall.

INDUSTRIAL APPLICABILITY

An impact tool of the present invention can be used to tighten a screw, a bolt, or the like, in a workplace.

The invention claimed is:

1. An impact tool comprising:

a spindle extending in an axial direction thereof;

a motor configured to provide the spindle with a rotational power in accordance with a motor current flowing therethrough, the rotational power rotating the spindle about the axis at an rpm value;

a rotational impact system configured to provide the spindle with an impact force in the axial direction, thereby transmitting both the rotational power and the impact force to an end bit;

a current detecting unit configured to detect a current value of the motor current; and a current control unit configured to reduce the current value if the current value detected by the current detecting unit exceeds a predetermined value;

wherein the current control unit reduces the current value during a first time period including a timing at which the rotational impact system provides the spindle with the impact force if the current value detected by the current detecting unit exceeds the predetermined value.

2. The impact tool according to claim 1, further comprising:

an rpm detecting unit configured to detect the rpm value; and a minimum rpm determining unit configured to determine a minimum rpm from a plurality of rpm values detected, during a second time period, by the rpm detecting unit;

wherein the current control unit starts to reduce the current value after a third time period has elapsed since the minimum rpm determining unit had determined the minimum rpm value.

3. The impact tool according to claim 2, further comprising:

a maximum rpm determining unit configured to determine a maximum rpm from the plurality of rpm values detected, during the second time period, by the rpm detecting unit; and a period changing unit configured to change the first time period based on a period after the maximum rpm is detected before the minimum rpm is detected.

4. The impact tool according to claim 3, further comprising an impact interval detecting unit configured to detect an impact interval at which the rotational impact system hits the end bit based on the period after the maximum rpm is detected before the minimum rpm is detected;

wherein the period changing unit changes the first time period so that the first time period becomes longer than a reference time period, if the impact interval detected by the impact interval detecting unit is longer than a reference interval, and wherein the period changing unit changes the first time period so that the first time period becomes shorter than the reference time period, if the impact interval detected by the impact interval detecting unit is shorter than the reference interval.

* * * * *